US005503296A

United States Patent [19]

DiBaggio

[11] Patent Number: 5,503,296

[45] Date of Patent: Apr. 2, 1996

[54] LIQUID CONTAINER AND NOVELTY ARTICLES

[75] Inventor: Anthony DiBaggio, Brooklyn, N.Y.

[73] Assignee: Tensai Group Corporation, Pine Bush, N.Y.

[21] Appl. No.: 278,507

[22] Filed: Jul. 21, 1994

[51] Int. Cl.[6] ..... B65D 77/26

[52] U.S. Cl. ..... 220/708; 206/459.5; 220/DIG. 13

[58] Field of Search ..... 215/1 A, 388, 215/389; D7/628; D9/307; 220/DIG. 13, 708, 710, 705, 709; 206/508, 459.5, 509

[56] References Cited

U.S. PATENT DOCUMENTS

| | | | |
|---|---|---|---|
| 2,200,275 | 5/1944 | Hothersall | 206/459.5 |
| 2,885,839 | 5/1959 | Weiss | 206/459.5 |
| 4,441,640 | 4/1984 | Lottick | 220/705 |
| 4,624,383 | 11/1986 | Moore | 206/509 |
| 4,778,392 | 10/1988 | Mitchell | 206/509 |
| 5,035,324 | 7/1991 | Bertrand | 206/508 |
| 5,211,298 | 5/1993 | Bloch | 220/709 |
| 5,282,541 | 2/1994 | Chen | 220/740 |
| 5,328,069 | 7/1994 | Cohanfard | 220/737 |

FOREIGN PATENT DOCUMENTS

| | | | |
|---|---|---|---|
| 1002595 | 3/1952 | France | 215/1 A |
| 2579959 | 10/1986 | France | 215/1 A |
| 2630415 | 1/1978 | Germany | 215/1 A |

*Primary Examiner*—Stephen J. Castellano

[57] ABSTRACT

The present invention relates to a self springing straw-equipped liquid drink container having a built-in straw in the shape of a spring that extends the straw when opened and retracts when the lid is closed pushing the straw into the container.

4 Claims, 7 Drawing Sheets

LIQUID CONTAINER AND NOVELTY ARTICLES

BACKGROUND OF THE INVENTION

1. Field of the Invention

The present invention relates to a straw-equipped liquid drink container, wherein the container is equipped with a straw in such a manner that the straw is insertable into and/or withdrawable from the container as required.

This invention is suitable especially for sports drinks to be taken mainly by those who are playing sports.

The present invention is directed to beverage straws for use in containers of beverages when shipped wherein the straw contains on its exterior a miniature of the container and wherein the straw and minicontainer may be removed from the container when the contents have been consumed.

The present invention relates generally to a container having a drinking tube incorporated therein and, more particularly, to a beverage container having a pop-up drinking dispensing tube.

2. Description of the Prior Art

Currently, beverage containers are manufactured, fitted and sealed in a high-speed automated process. This process includes manufacturing a separate body for containing the fluid or beverage and a separate lid for sealing the open end of the body. During manufacture of the beverage container, a manufacturing operation known as "seaming" 0 places the lid on a filled can body and seals its perimeter. At present, known seaming operations slide the lids horizontally across the top edge of the beverage container. The seaming operation involves the use of very expensive high speed machinery and tooling.

Previously, there have been attempts to provide a drinking/dispensing tube device such as a straw in beverage containers. An example is disclosed in U.S. Pat. No. 4,728,001, issued. Mar. 1. 1988, for inventor Serba. In this patent, the drinking straw floats on top of the beverage and has its ends bent at an angle to allow removal. However, a disadvantage with this patented device is that the end user must attempt to manually rotate the straw into position beneath the orifice by inserting a finger or other object through the sharp orifice into the container body interior. Once the straw has been positioned, the user must then grab the straw, pull it out through the orifice, straighten its convolute, then rein sen the straw back into the container body.

Another example of a drinking/dispensing tube device is disclosed in U.S. Pat. No. 4,109,817 issued Aug. 29, 1978, for inventors Payne et al. This patent discloses a straw assembly for a liquid container in which a straw has a float mounted on its bottom end to use through the orifice once the pull-tab closure is removed. However, one disadvantage of this patented device is that the seaming process must be changed such that the lid orifice position is aligned with the straw. Such aligning is not current practice and may not be commercially feasible. Another disadvantage is that the device requires a style of lid which is now obsolete due to environmental and safety reasons. This style of lid has a tab closure which is completely removed an separated from the lid by the end-user during opening of the beverage container.

Beverage bottles containing straws and floats attached thereto within the bottle contents capped for shipment and sale have been known at least since the following patents:

U.S. Pat. No. 1,253,579 S. A. Deanes

U.S. Pat. No. 1,309,994 J. W. McAuliffe

U.S. Pat. No. 3,099,565 R. L. Neuhauser

U.S. Pat. No. 3,656,654 W. J. Brinkley III

U.S. Pat. No. 4,305,531 H. Komatsuta

Other bottles in combination with straws within bottle contents transported in the capped condition are shown in the following patents:

U.S. Pat. No. 2,613,988 C. F. Jarbeau

U.S. Pat. No. 3,291,331 C. R. Brisham et al

U.S. Pat. No. 3,074,610 W. A. Pugh

Floats in combination with straws and muddlers for use in beverage glasses are shown in the following patents:

U.S. Pat. No. 1,916,646 S. Tyco

U.S. Pat. No. 4,134,494 W. T. Wong

Conventionally, there has been no drink container equipped with a straw. When one desires to drink the liquid contained in a container such as a bottle and the like he takes the container up to his mouth and drinks the liquid direct from the mouth of the container, or he inserts a straw into the container and drinks the liquid through the straw. Thus, it may not be possible for him to drink quickly and smoothly.

SUMMARY OF THE INVENTION

None of the art known to us at the time of filling this application for patent teach or suggest the combination of a beverage straw and mini-buoyant chamber in the miniature form of the beverage container in which the beverage, straw, and mini-buoyant container are shipped wherein the mini-buoyant container secured to the straw contains an advertising message during transport, while on sale display in stores, while the beverage is being consumed by the customer and after the straw has been removed from the container. During all these various stages of transport and consumption the mini-buoyant container has beamed the commercial message to all who see it either inside or externally of the bottle even when being played with by a child.

It is one object of the present invention to provide a straw or drinking/dispensing tube or the like for use in beverage containers as the containers are shipped in a sealed condition from bottling or canning factories.

It is another object of the present invention to eliminate the need for end-users to manually insert drinking straws into beverage containers.

It is further object of the present invention to provide manufacturers and consumers of existing beverage containers with a drinking/dispensing device which can be integrated with known existing beverage containers.

It is another object of the present invention a more sanitary beverage drinking/dispensing device than is currently available under known existing beverage containers.

It is further object of the present invention to provide a device which can be inserted into a beverage container for the purpose of moving a straw which is contained within the interior of the beverage container so that the straw becomes aligned with the orifice of the container lid in such a way as to render the straw accessible for upward extension and/or removal from the container through the orifice.

It is still further object of the present invention to cause the downward vertical motion of a beverage lid's closure tab (as it is being opened) to move the straw into a position directly beneath the lid's orifice.

It is still another object of the present invention to facilitate the drinking and/or dispensing of beverages by children and/or handicapped or elderly adults whose motor skills cannot attain the same level of control and precision as normal adults.

It is still further object of the present invention to help minimize or eliminate waste spillage of the beverage which can occur as a result of sloppy drinking and/or dispensing practices or as a result of environmental difficulties such as those present during a bumpy car, plane, or train ride.

It is another object of the present invention to provide in a beverage container a straw which embodies compressed circumferential folds or convoluted ridges or rings which enable the straw's length to be increased or decreased by extension or further compression of the folds or ridges, and which enable the straw to be bent at an angle without causing the kind of collapse in its wall which would obstruct the flow of the beverage through the straw.

It is a further object of the present invention to provide in a beverage container a straw which is capable of being bent at an angle or about a radius without the aid of any external force or external molding or shaping apparatus which is additional to the initial force or apparatus required to first form the bend.

Accordingly, the present invention is a device for a container. The container includes a tubular body having a closed end, an open end and a longitudinal axis. A lid which has an orifice is secured to the open end. A closure tab is pivotally connected to the lid and temporarily closes the orifice. An actuating member is pivotally secured to the lid and is being manually actuated for moving closure tab into the interior of the body to open the orifice in the lid. The device includes a conduit disposed within the body. A means is disposed within the body and adapted to engage the body for supporting the conduit substantially parallel to the longitudinal axis of the body. Another means forms a float for elevating the conduit through the orifice in the lid when liquid is present within the body and the tab is deflected into the interior of the body to open the orifice.

The object of the present invention is therefore to provide a straw-equipped liquid drink container with a seal cap openable by one touch to allow one end portion of the straw to spring out through the mouth or opening of the container to thus enable one to drink the liquid quickly and very easily and also force the straw into the container through the mouth or opening and to seal it again.

The straw-equipped drink container of the present invention is characterized in that the straw accommodated in the container may spring out of the container by the action of a spring instantaneously when the seal cap of the container is removed from the container.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10 - baseball shaped container 10
10A - baseball shaped container lid 10A
10B - baseball shaped container hinge 10B
10C - baseball shaped container hook 10C
10D - baseball shaped container latch 10D
10E - baseball shaped container circular opening 10E
10F - baseball shaped container straw seal 10F
10G - baseball shaped container lid inset 10G
10H - upper baseball stitching design 10H
10I - baseball shaped container lid finger grip 10I
10J - baseball shaped container straw centering upper mechanism 10J
12 - football shaped container 12
12A - football shaped container lid 12A
12B - football shaped container hinge 12B
12C - football shaped container hook 12C
12D - football shaped container latch 12D
12E - football shaped container circular opening 12E
12F - football shaped container straw seal 12F
12G - football shaped container lid inset 12G
12H - football shaped container straw weight 12H
13 - lower baseball stitching design 13
14 - bowling pin shaped container 14
14A - bowling pin shaped container lid 14A
14B - bowling pin shaped container hinge 14B
14C - bowling pin shaped container hook 14C
14D - bowling pin shaped container latch 14D
14E - bowling pin shaped container circular opening 14E
14F - bowling pin shaped container straw seal 14F
14G - bowling pin shaped container lid inset 14G
14H - horizontal bowling pin stripes 14H
14J - bowling pin shaped container straw centering upper mechanism 14J
16 - alphabet block shaped container 16
16A - alphabet block shaped container lid 16A
16B - alphabet block shaped container hinge 16B
16C - alphabet block shaped container hook 16C
16D - alphabet block shaped container latch 16D
16E - alphabet block shaped container square opening 16E
16F - alphabet block shaped container straw seal 16F
16G - alphabet block shaped container lid inset 16G
16H - changeable alphabet block letters 16H
16I - alphabet block shaped container indentation 16I
18 - straw 18
18A - upper straight portion of straw 18A
18C - straw seal 18C
18D - lower spiral portion of straw 18D
18E - straw cap 18E
18F - bottom end of straw 18F

BRIEF DESCRIPTION OF THE PREFERRED EMBODIMENT

FIG. 1 is a transparent side view of the baseball shaped straw-equipped liquid drink container FIG. 2 is a top view of the baseball shaped straw-equipped liquid drink container FIG. 3 is a cross sectional view of the baseball shaped straw-equipped liquid drink container FIG. 3A is a cross sectional view of the baseball shaped straw-equipped liquid drink container with the straw fully extended FIG. 4 is a transparent side view of the football shaped straw-equipped liquid drink container FIG. 4A is a transparent side view of the football shaped straw-equipped liquid drink container with the straw fully extended FIG. 5 is a transparent side view of the bowling pin shaped straw-equipped liquid drink container FIG. 5A is a transparent side view of the bowling pin shaped straw-equipped liquid drink container with the straw fully extended FIG. 6 is a transparent side view of the alphabet block shaped straw-equipped liquid drink container FIG. 6A is a transparent side view of the alphabet block shaped straw-equipped liquid drink container with the straw fully extended FIG. 7 is a top view of the alphabet block shaped straw-equipped liquid drink container FIG. 8 is a cross section side view of the alphabet block shaped straw-equipped liquid drink container FIG. 8A is a cross section side view of the stackability of the alphabet block shaped straw-equipped liquid drink container.

DETAILED DESCRIPTION OF THE PREFERRED EMBODIMENT

Figure 1:
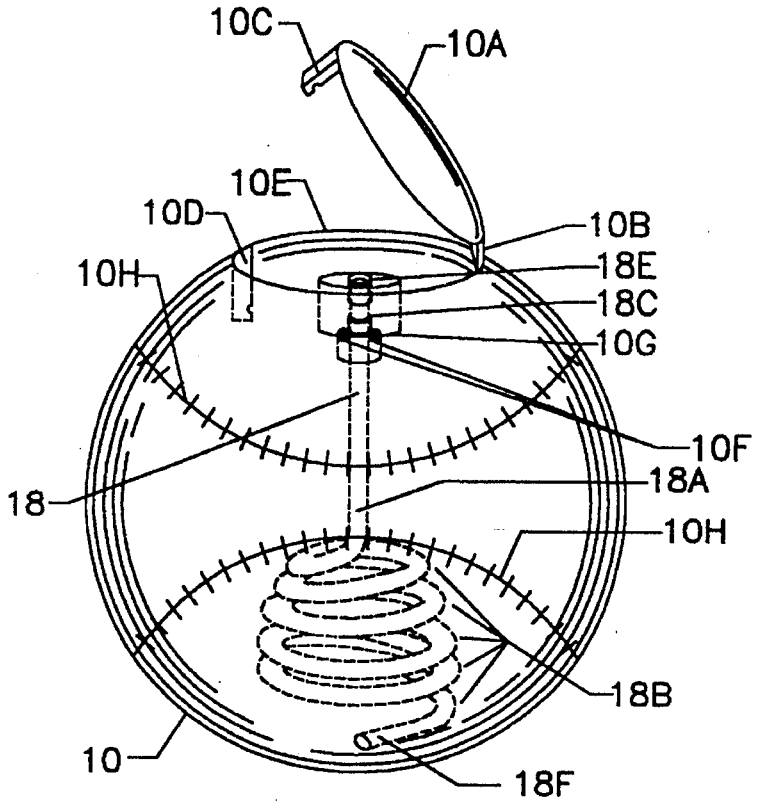

Firstly, referring to FIG. 1, which is a transparent side view of the baseball shaped straw-equipped liquid drink container, exhibiting the following features: baseball shaped container 10 with a straw 18 inside the container that springs up when the baseball shaped container lid 10A is opened due to the lower spiral portion of straw 18D acting as a spring mechanism; baseball shaped container lid 10A keeps the liquid and the straw 18 inside of the baseball shaped container 10; hinge 10B allows the baseball shaped container lid 10A to open and close on top of the baseball shaped container 10; baseball shaped container hook 10C on the baseball shaped container lid 10A of the baseball shaped container 10 to keep the baseball shaped container lid 10A closed; baseball shaped container latch 10D secures the baseball shaped container hook 10C to the baseball shaped container 10 to keep the baseball shaped container lid 10A closed; baseball shaped container circular opening 10E that the baseball shaped container lid 10A fits over coveting the straw 18; baseball shaped container straw seal 10F that seals baseball shaped container 10 when pressed down on to the straw seal 18C upon closing the baseball shaped container lid 10A; baseball shaped container lid inset 10G covers inside the baseball shaped container lid 10A so that the baseball shaped container 10 is sealed when the baseball shaped container straw seal 10F meets the straw seal 18C; upper baseball stitching design 10H gives the container the appearance of a baseball; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 2:
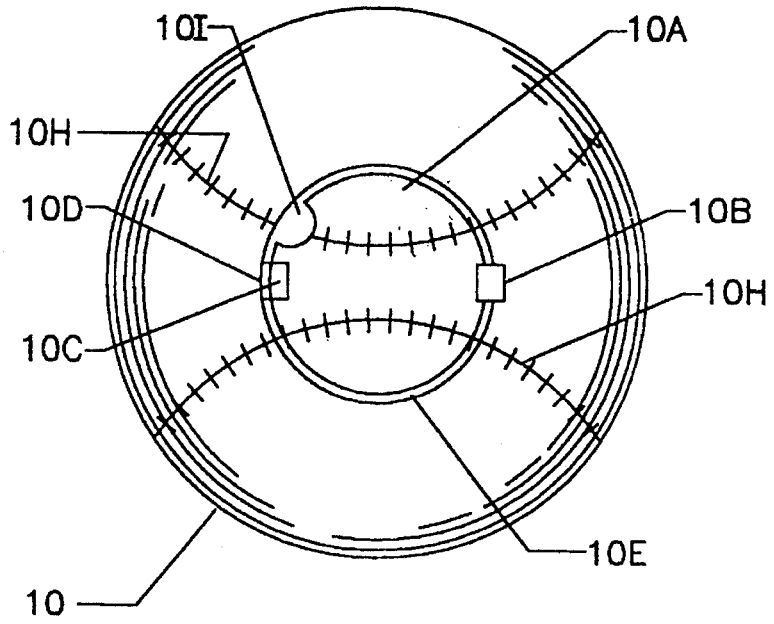

Now referring to FIG. 2 which is a top view of the baseball shaped straw-equipped liquid drink container exhibiting the following features: baseball shaped container 10 with a straw 18 inside the container that springs up when the baseball shaped container lid 10A is opened due to the lower spiral portion of straw 18D acting as a spring mechanism; baseball shaped container lid 10A keeps the liquid and the straw 18 inside of the baseball shaped container 10; baseball shaped container hinge 10B allows the baseball shaped container lid 10A to open and close on top of the baseball shaped container 10; baseball shaped container hook 10C on the baseball shaped container lid 10A of the baseball shaped container 10 to keep the baseball shaped container lid 10A closed; baseball shaped container latch 10D secures the hook 10C to the baseball shaped container 10 to keep the baseball shaped container lid 10A closed; baseball shaped container circular opening 10E that the baseball shaped container lid 10A fits over coveting the straw 18; upper baseball stitching design 10H gives the container the appearance of a baseball; baseball shaped container lid finger grip 10I to release the baseball shaped container hook 10C from the baseball shaped container latch 10D by pressing the baseball shaped container lid finger grip 10I in and then pulling up.

Figure 3:
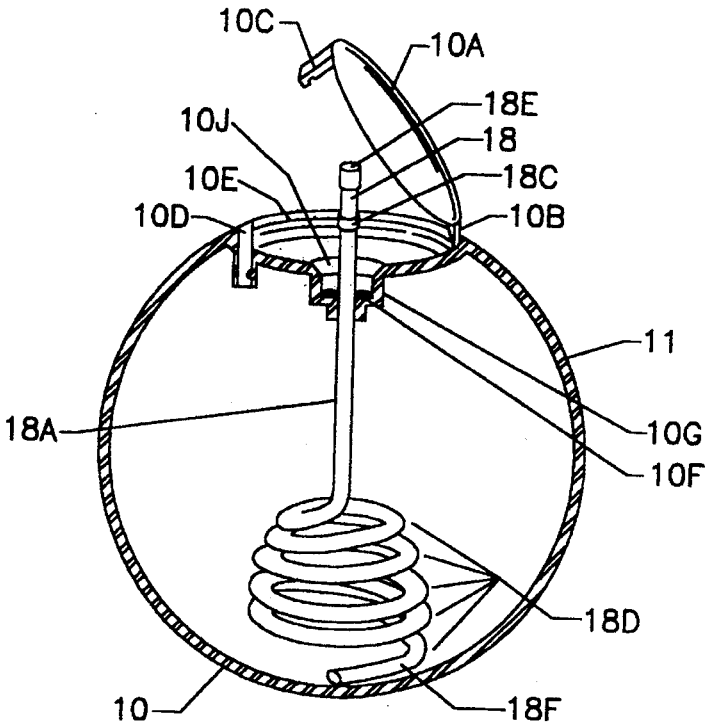

Now, referring to FIG. 3, which is a cross sectional view of the baseball shaped straw-equipped liquid drink container exhibiting the following features: baseball shaped container 10 with a straw 18 inside the container that springs up when the baseball shaped container lid 10A is opened due to the lower spiral portion of straw 18D acting as a spring mechanism; baseball shaped container lid 10A keeps the liquid and the straw 18 inside of the baseball shaped container 10; baseball shaped container hinge 10B allows the baseball shaped container lid 10A to open and close on top of the baseball shaped container 10; baseball shaped container hook 10C on the baseball shaped container lid 10A of the baseball shaped container 10 to keep the baseball shaped container lid 10A closed; baseball shaped container latch 10D secures the baseball shaped container hook 10C to the baseball shaped container 10 to keep the baseball shaped container lid 10A closed; baseball shaped container circular opening 10E that the baseball shaped container lid 10A fits over covering the straw 18; baseball shaped container straw seal 10F that seals baseball shaped container 10 when pressed down on to the straw seal 18C upon closing the baseball shaped container lid 10A; baseball shaped container lid inset 10G covers inside the baseball shaped container lid 10A so that the baseball shaped container 10 is sealed when the baseball shaped container straw seal 10F meets the straw seal 18C; baseball shaped container lid inset 10G covers inside the baseball shaped container lid 10A so that the baseball shaped container 10 is sealed when the baseball shaped container straw seal 10F meets the straw seal 18C; baseball shaped container straw centering upper mechanism 10J keeps the straw 18 in the center of the baseball shaped container 10 in order to pass through the baseball shaped container circular opening 10E; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container.

Figure 3A:
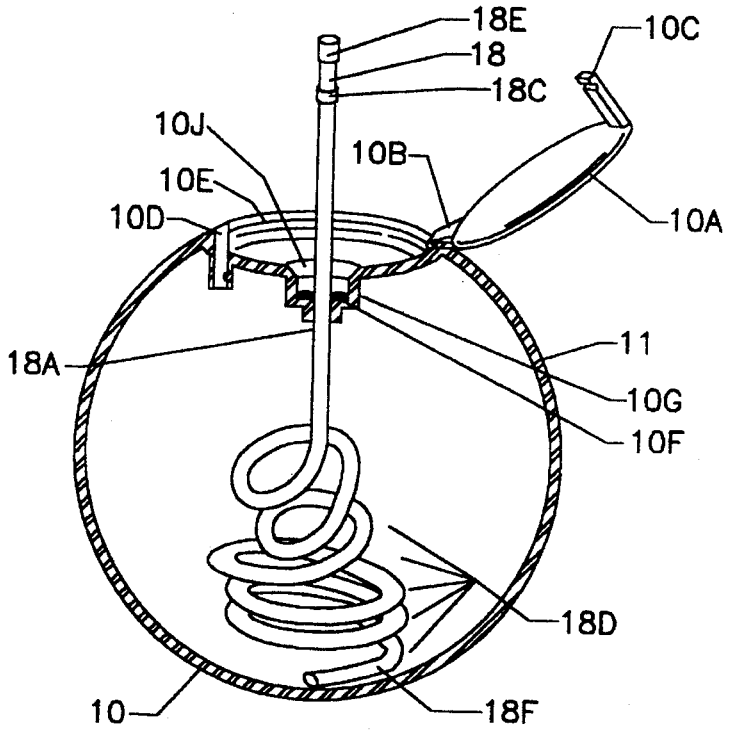

Now, referring to FIG. 3A, which is a cross sectional view of the baseball shaped straw-equipped liquid drink container with the straw fully extended exhibiting the following features: baseball shaped container 10 with a straw 18 inside the container that springs up when the baseball shaped container lid 10A is opened due to the lower spiral portion of straw 18D acting as a spring mechanism; baseball shaped container lid 10A keeps the liquid and the straw 18 inside of the baseball shaped container 10; baseball shaped container hinge 10B allows the baseball shaped container lid 10A to open and close on top of the baseball shaped container 10; baseball shaped container hook 10C on the baseball shaped container lid 10A of the baseball shaped container 10 to keep the baseball shaped container lid 10A closed; baseball shaped container latch 10D secures the baseball shaped container hook 10C to the baseball shaped container 10 to keep the baseball shaped container lid 10A closed; baseball shaped container circular opening 10E that the baseball shaped container lid 10A fits over covering the straw 18; baseball shaped container straw seal 10F that seals baseball shaped container 10 when pressed down on to the straw seal 18C upon closing the baseball shaped container lid 10A; baseball shaped container lid inset 10G covers inside the baseball shaped container lid 10A so that the baseball shaped container 10 is sealed when the baseball shaped container straw seal 10F meets the straw seal 18C; baseball shaped container lid inset 10G covers inside the baseball shaped container lid 10A so that the baseball shaped container 10 is sealed when the baseball shaped container straw seal 10F meets the straw seal 18C; baseball shaped container straw centering upper mechanism 10J keeps the straw 18 in the center of the baseball shaped container 10 in order to pass through the baseball shaped container circular opening 10E; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container.

Figure 4:
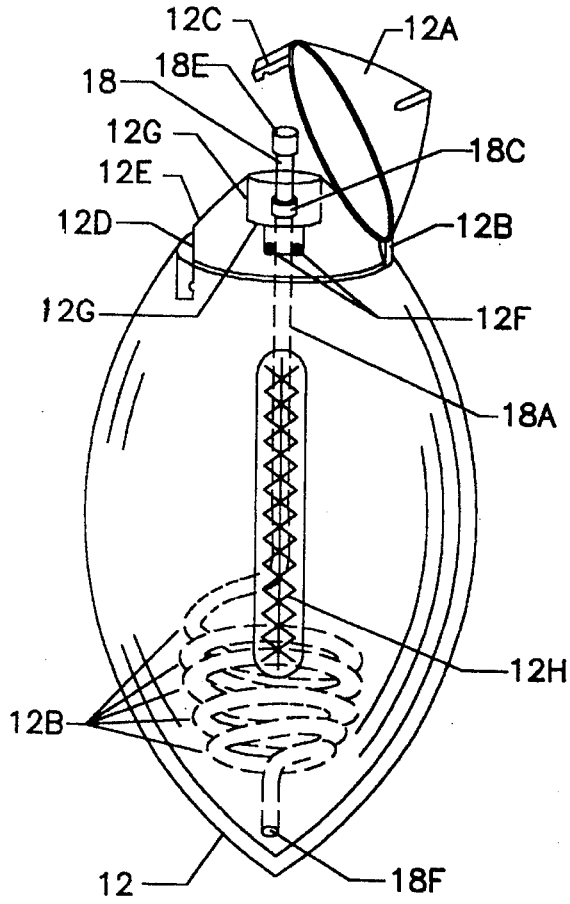

Now, referring to FIG. 4, which is a transparent side view of the football shaped straw-equipped liquid drink container exhibiting the following features: football shaped container 12 with a straw 18 inside the container that springs up when the football shaped container lid 12A is opened due to the lower spiral portion of straw 18D acting as a spring mechanism; football shaped container lid 12A keeps the liquid and the straw 18 inside of the football shaped container 12; hinge 12B allows the football shaped container lid 12A to open and close on top of the football shaped container 12; football shaped container hook 12C on the football shaped container lid 12A of the football shaped container 12 to keep the football shaped container lid 12A closed; football shaped container latch 12D secures the football shaped container hook 12C to the football shaped container 12 to keep the football shaped container lid 12A closed; football shaped container circular opening 12E that the football shaped container lid 12A fits over covering the straw 18; football shaped container straw seal 12F that seals football shaped container 12 when pressed down on to the straw seal 18C upon closing the football shaped container lid 12A; football shaped container lid inset 12G covers inside the football shaped container lid 12A so that the football shaped container 12 is sealed when the football shaped container straw seal 12F meets the straw seal 18C; football shaped container straw weight 12H keeps the straw 18 at the bottom of the football shaped container 12; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 4A:
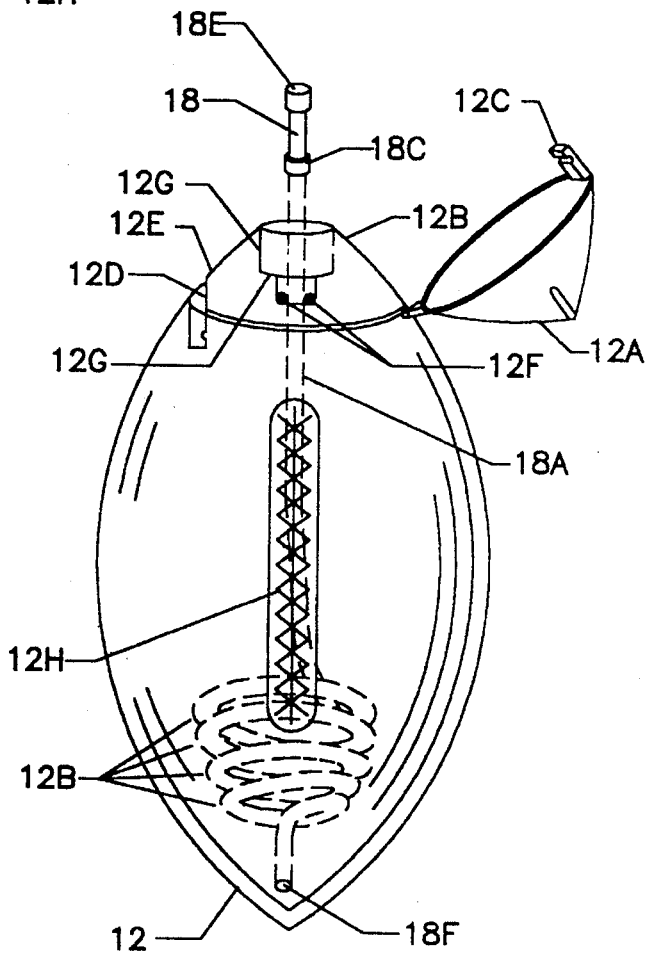

Now, referring to FIG. 4A, which is a transparent side view of the football shaped straw-equipped liquid drink container with the straw fully extended exhibiting the following features: football shaped container 12 with a straw 18 inside the container that springs up when the football shaped container lid 12A is opened due to the lower spiral portion of straw 18D acting as a spring mechanism; football shaped container lid 12A keeps the liquid and the straw 18 inside of the football shaped container 12; hinge 12B allows the football shaped container lid 12A to open and close on top of the football shaped container 12; football shaped container hook 12C on the football shaped container lid 12A of the football shaped container 12 to keep the football shaped container lid 12A closed; football shaped container latch 12D secures the football shaped container hook 12C to the football shaped container 12 to keep the football shaped container lid 12A closed; football shaped container circular opening 12E that the football shaped container lid 12A fits over covering the straw 18; football shaped container straw seal 12F that seals football shaped container 12 when pressed down on to the straw seal 18C upon closing the football shaped container lid 12A; football shaped container lid inset 12G covers inside the football shaped container lid 12A so that the football shaped container 12 is sealed when the football shaped container straw seal 12F meets the straw seal 18C; football shaped container straw weight 12H keeps the straw 18 at the bottom of the football shaped container 12; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 5:
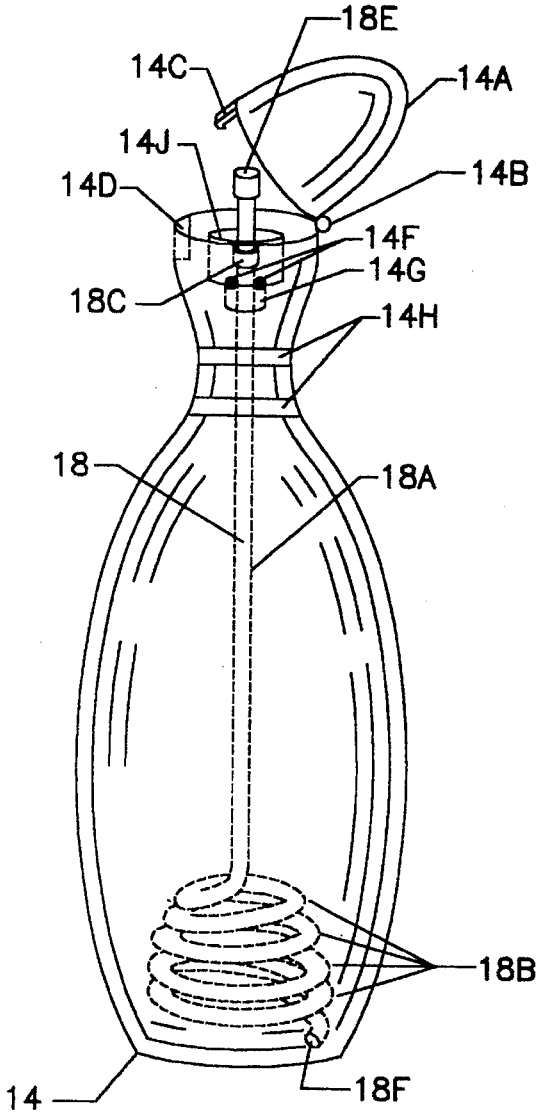

Now referring to FIG. 5, which is a transparent side view of the bowling pin shaped straw-equipped liquid drink container exhibiting the following features: bowling pin shaped container 14 with a straw 18 inside the container that springs up when the bowling pin shaped container lid 14A is opened due to the lower spiral portion of straw 18D acting as a spring mechanism; bowling pin shaped container lid 14A keeps the liquid and the straw 18 inside of the bowling pin shaped container 14; bowling pin shaped container hinge 14B allows the bowling pin shaped container lid 14A to open and close on top of the bowling pin shaped container 14; bowling pin shaped container hook 14C on the bowling pin shaped container lid 14A of the bowling pin shaped container 14 to keep the bowling pin shaped container lid 14A closed; bowling pin shaped container latch 14D secures the hook 14C to the bowling pin shaped container 14 to keep the bowling pin shaped container lid 14A closed; circular opening 14E that the bowling pin shaped container lid 14A fits over covering the straw 18; bowling pin shaped container straw seal 14F that seals bowling pin shaped container 14 when pressed down on to the straw seal 18C upon closing the bowling pin shaped container lid 14A; bowling pin shaped container lid inset 14G covers inside the bowling pin shaped container lid 14A so that the bowling pin shaped container 14 is sealed when the bowling pin shaped container straw seal 14F meets the straw seal 18C; horizontal bowling pin stripes 14H gives the container the appearance of a bowling pin; bowling pin shaped container straw centering upper mechanism 14J keeps the straw 18 in the center of the bowling pin shaped container 14 in order to pass through the bowling pin shaped container circular opening 14E; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 5A:
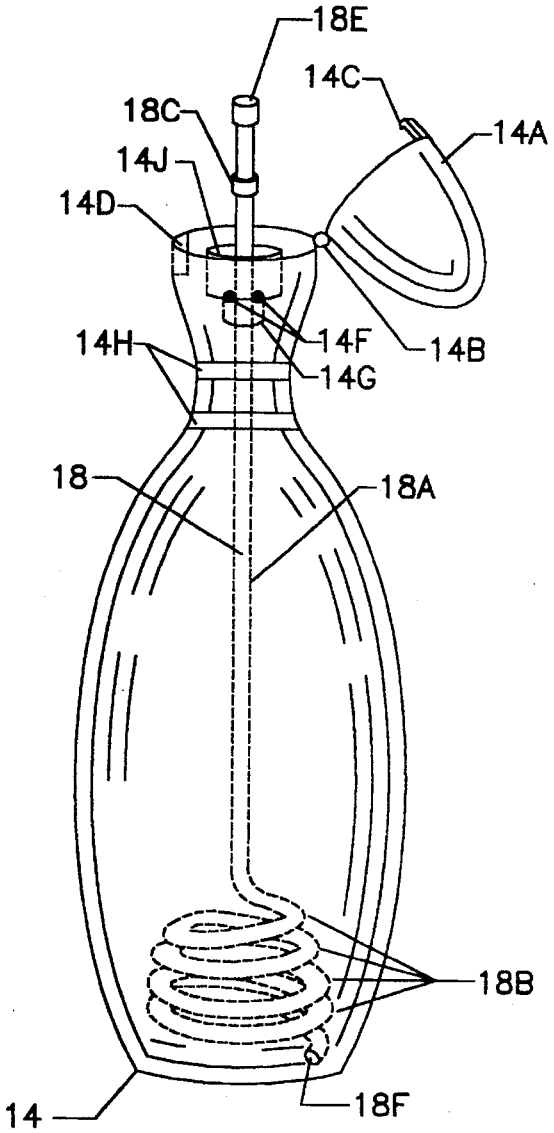

Now referring to FIG. 5A, which is a transparent side view of the bowling pin shaped straw-equipped liquid drink container with the straw fully extended exhibiting the following features: bowling pin shaped container 14 with a straw 18 inside the container that springs up when the bowling pin shaped container lid 14A is opened due to the lower spiral portion of straw 18D acting as a spring mechanism; bowling pin shaped container lid 14A keeps the liquid and the straw 18 inside of the bowling pin shaped container 14; bowling pin shaped container hinge 14B allows the bowling pin shaped container lid 14A to open and close on top of the bowling pin shaped container 14; bowling pin shaped container hook 14C on the bowling pin shaped container lid 14A of the bowling pin shaped container 14 to keep the bowling pin shaped container lid 14A closed; bowling pin shaped container latch 14D secures the hook 14C to the bowling pin shaped container 14 to keep the bowling pin shaped container lid 14A closed; circular opening 14E that the bowling pin shaped container lid 14A fits over covering the straw 18; bowling pin shaped container straw seal 14F that seals bowling pin shaped container 14 when pressed down on to the straw seal 18C upon closing the bowling pin shaped container lid 14A; bowling pin shaped container lid inset 14G covers inside the bowling pin shaped container lid 14A so that the bowling pin shaped container 14 is sealed when the bowling pin shaped container straw seal 14F meets the straw seal 18C; horizontal bowling pin stripes 14H gives the container the appearance of a bowling pin; bowling pin shaped container straw centering upper mechanism 14J keeps the straw 18 in the center of the bowling pin shaped container 14 in order to pass through the bowling pin shaped container circular opening 14E; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 6:
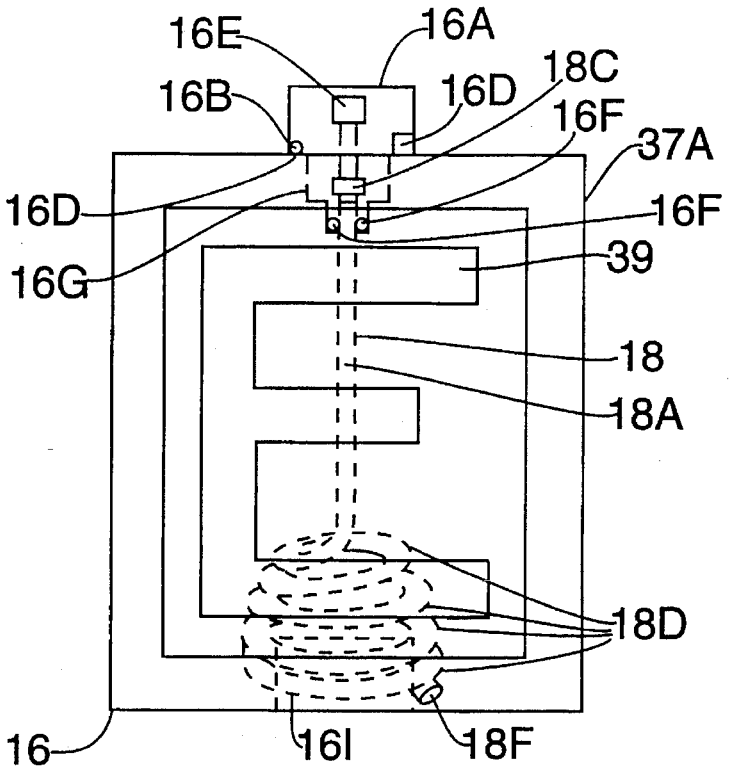

Now referring to FIG. 6, which is a transparent side view of the alphabet block shaped straw-equipped liquid drink container exhibiting the following features: alphabet block shaped container 16 with a straw 18 inside the container that springs up when the alphabet block shaped container lid 16A is opened due to the lower spiral portion of straw 18D acting as a spring mechanism; alphabet block shaped container lid 16A keeps the liquid and the straw 18 inside of the alphabet block shaped container 16; alphabet block shaped container hinge 16B allows the alphabet block shaped container lid 16A to open and close on top of the alphabet block shaped container 16; alphabet block shaped container hook 16C on the alphabet block shaped container lid 16A of the alphabet block shaped container 16 to keep the alphabet block shaped container lid 16A closed; alphabet block shaped container latch 16D secures the alphabet block shaped container hook 16C to the alphabet block shaped container 16 to keep the alphabet block shaped container lid 16A closed; alphabet block shaped container square opening 16E that the alphabet block shaped container lid 16A fits over covering the straw 18; alphabet block shaped container straw seal 16F that seals alphabet block shaped container 16 when pressed down on to the straw seal 18C upon closing the alphabet block shaped container lid 16A; alphabet block shaped container lid inset 16G covers inside the alphabet block shaped container lid 16A so that the alphabet block shaped container 16 is sealed when the alphabet block shaped container straw seal 16F meets the straw seal 18C; changeable alphabet block letters 16H attach to the sides of the alphabet block shaped container 16; alphabet block shaped container indentation 16I on the bottom of the alphabet block shaped container 16 that is slightly larger than the alphabet block shaped container lid 16A in order for another alphabet block shaped container 16 to fit inside the alphabet block shaped container indentation 16I so that a plurality of alphabet block shaped containers 16 can be stacked; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container;, bottom end of straw 18F draws the liquid in from the container up the straw to the user.

Figure 6A:
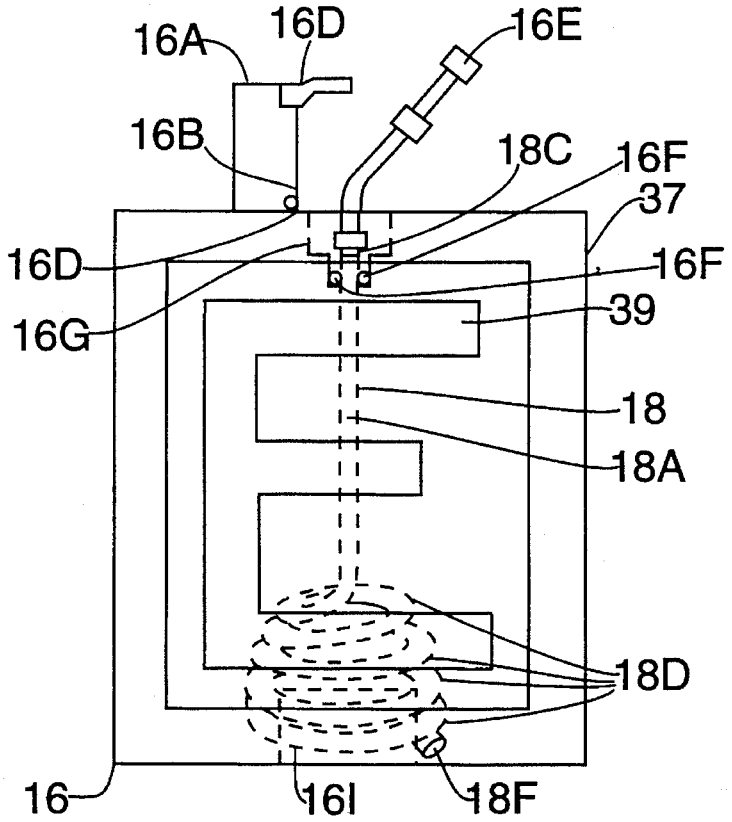

Now referring to FIG. 6A, which is a transparent side view of the alphabet block shaped straw-equipped liquid drink container with the straw fully extended exhibiting the following features: alphabet block shaped container 16 with a straw 18 inside the container that springs up when the alphabet block shaped container lid 16A is opened due to the lower spiral portion of straw 18D acting as a spring mechanism; alphabet block shaped container lid 16A keeps the liquid and the straw 18 inside of the alphabet block shaped container 16; alphabet block shaped container lid 16B allows the alphabet block shaped container lid 16A to open and close on top of the alphabet block shaped container 16; alphabet block shaped container hook 16C on the alphabet block shaped container lid 16A of the alphabet block shaped container 16 to keep the alphabet block shaped container lid 16A closed; alphabet block shaped container latch 16D secures the alphabet block shaped container hook 16C to the alphabet block shaped container 16 to keep the alphabet block shaped container lid 16A closed; alphabet block shaped container square opening 16E that the alphabet block shaped container lid 16A fits over covering the straw 18; alphabet block shaped container straw seal 16F that seals alphabet block shaped container 16 when pressed down on to the straw seal 18C upon closing the alphabet block shaped container lid 16A; alphabet block shaped container lid inset 16G covers inside the alphabet block shaped container lid 16A so that the alphabet block shaped container 16 is sealed when the alphabet block shaped container straw seal 16F meets the straw seal 18C; changeable alphabet block letters 16H attach to the sides of the alphabet block shaped container 16; alphabet block shaped container indentation 16I on the bottom of the alphabet block shaped container 16 that is slightly larger than the alphabet block shaped container lid 16A in order for another alphabet block shaped container 16 to fit inside the alphabet block shaped container indentation 16I so that a plurality of alphabet block shaped containers 16 can be stacked; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw seal 18C seals the top of the straw 18 when the lid is closed over the straw 18; straw cap 18E protects the liquid in the straw 18 when the straw 18 has been extended out the top of the container; bottom end of straw 18F draws the liquid in from the container up the straw to the user.

Figure 7:
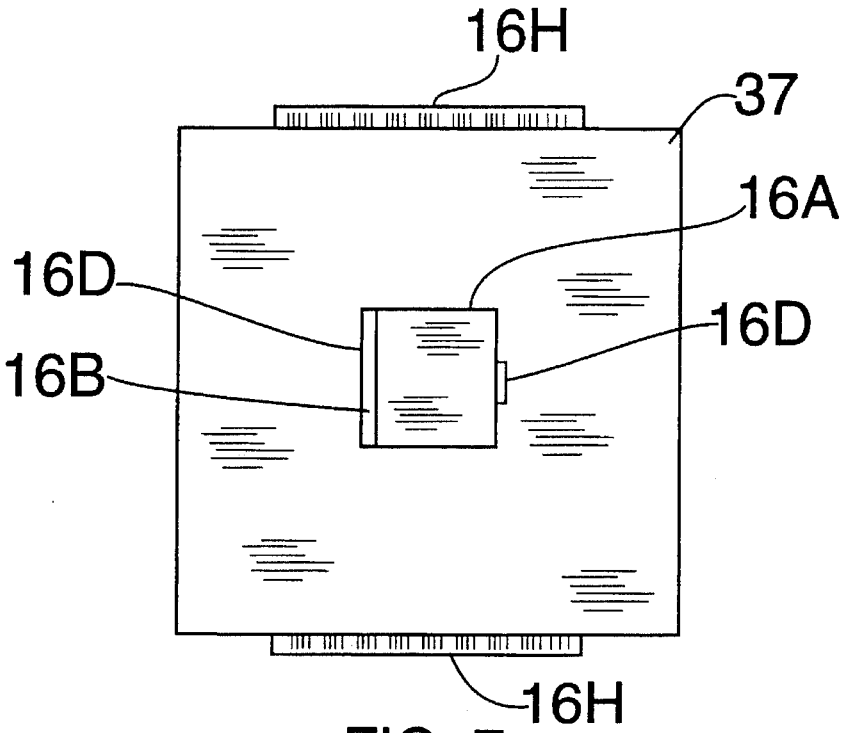

Now referring to FIG. 7, which is a top view of the alphabet block shaped straw-equipped liquid drink container exhibiting the following features: alphabet block shaped container 16 with a straw 18 inside the container that springs up when the alphabet block shaped container lid 16A is opened due to the lower spiral portion of straw 18D acting as a spring mechanism; alphabet block shaped container lid 16A keeps the liquid and the straw 18 inside of the alphabet block shaped container 16; alphabet block shaped container lid 16B allows the alphabet block shaped container lid 16A to open and close on top of the alphabet block shaped container 16; alphabet block shaped container hook 16C on the alphabet block shaped container lid 16A of the alphabet block shaped container 16 to keep the alphabet block shaped container lid 16A closed; alphabet block shaped container latch 16D secures the alphabet block shaped container hook 16C to the alphabet block shaped container 16 to keep the alphabet block shaped container lid 16A closed; changeable alphabet block letters 16H attach to the sides of the alphabet block shaped.

Figure 8:
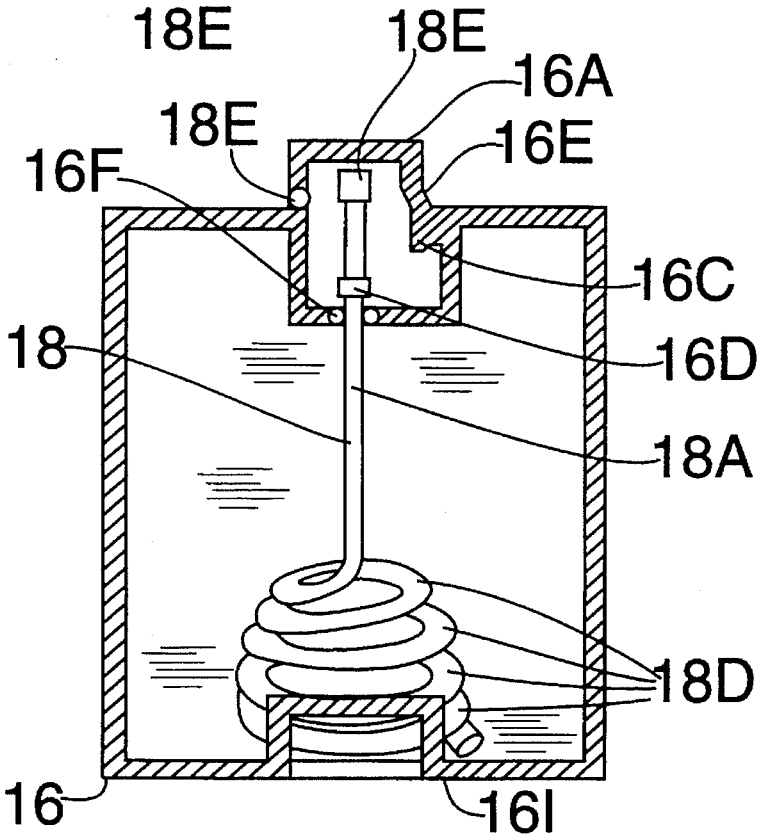
Figure 8A:
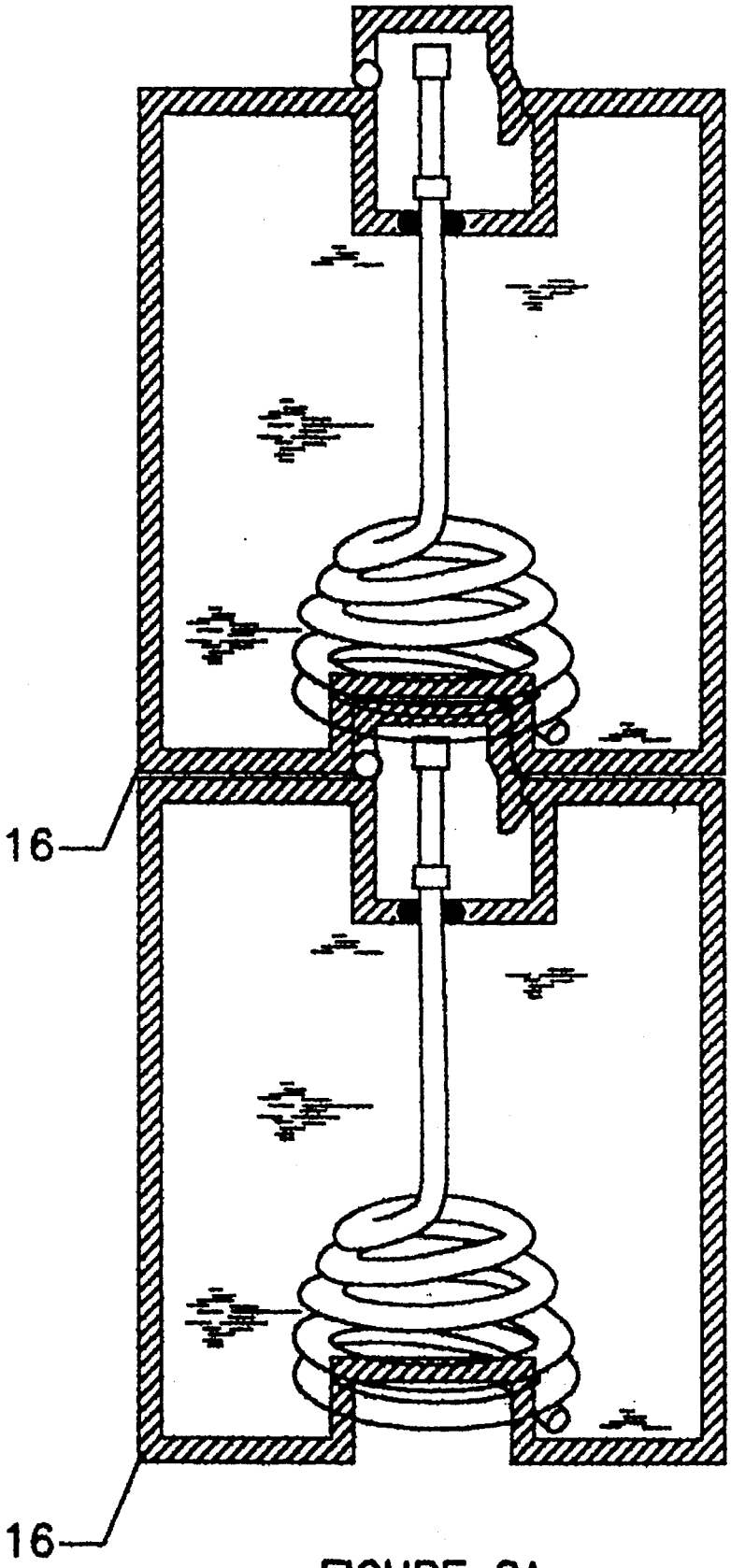

Lastly, referring to FIG. 8, which is a cross section side view of the alphabet block shaped straw-equipped liquid drink container exhibiting the following features: alphabet block shaped container 16 with a straw 18 inside the container that springs up when the alphabet block shaped container lid 16A is opened due to the lower spiral portion of straw 18D acting as a spring mechanism; alphabet block shaped container lid 16A keeps the liquid and the straw 18 inside of the alphabet block shaped container 16; alphabet block shaped container lid 16B allows the alphabet block shaped container lid 16A to open and close on top of the alphabet block shaped container 16; alphabet block shaped container hook 16C on the alphabet block shaped container lid 16A of the alphabet block shaped container 16 to keep the alphabet block shaped container lid 16A closed; alphabet block shaped container latch 16D secures the alphabet block shaped container hook 16C to the alphabet block shaped container 16 to keep the alphabet block shaped container lid 16A closed; alphabet block shaped container straw seal 16F that seals alphabet block shaped container 16 when pressed down on to the straw seal 18C upon closing the alphabet block shaped container lid 16A; alphabet block shaped container lid inset 16G covers inside the alphabet block shaped container lid 16A so that the alphabet block shaped container 16 is sealed when the alphabet block shaped container straw seal 16F meets the straw seal 18C; alphabet block shaped container indentation 16I on the bottom of the alphabet block shaped container 16 that is slightly larger than the alphabet block shaped container lid 16A in order for another alphabet block shaped container 16 to fit inside the alphabet block shaped container indentation 16I so that a plurality of alphabet block shaped containers 16 can be stacked; straw 18 that fits inside of the various containers to drink the liquid contained therein; upper straight portion of straw 18A that extends up out of the containers when the lid is opened; lower spiral portion of straw 18B acts as a coil spring to push the upper straight portion of straw 18A out of the container to drink the liquid contained therein; straw cap 18E protects the liquid in the straw 18 when the straw 18 has been extended out the top of the container.

It will be understood that each of the elements described above, or two or more together, may also find a useful application in other types of constructions differing from the type described above.

While the invention has been illustrate and described as embodied in a straw-equipped drink container, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent: is set forth in the appended claims.

I claim:

1. A self springing straw-equipped liquid drink container, comprising:

a) a container body containing a container body opening, said container body being shaped to resemble a block, said block having indica contained thereon;

b) a straw contained within said container body and consisting of:

I) a lower spiral portion being a spring-like mechanism, ii) stopping means preventing said straw from being completely inserted into said container body, and iii) an upper portion being straight for drinking, said container body opening having a seal for said straw;

c) a lid keeping said liquid and said straw inside of said container body and having a hinge allowing said lid to open and close on top of said container body; and d) fastening means located on said lid having a male hooking mechanism with a corresponding female latching receptacle located in said container body for keeping said lid closed, said container body having an indentation on a bottom of said container body slightly larger than said lid in order for a second container to fit inside said indentation forming a plurality of alphabet block shaped stacked containers.

2. The self springing straw-equipped liquid drink container as described in claim 1, wherein said upper portion of said straw has a cap protecting said liquid from spilling.

3. The self springing straw-equipped liquid drink container as described in claim 1, wherein said indica is letters from the alphabet.

4. The self springing straw-equipped liquid drink container as described in claim 1, wherein said indica is numbers.

* * * * *